US011128956B2

(12) United States Patent
Kikuchi et al.

(10) Patent No.: US 11,128,956 B2
(45) Date of Patent: Sep. 21, 2021

(54) EDGE OF DIAPHRAGM AND SPEAKER UNIT

(71) Applicant: SONY CORPORATION, Tokyo (JP)

(72) Inventors: Kohei Kikuchi, Saitama (JP); Nobukazu Suzuki, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/620,927

(22) PCT Filed: Jun. 14, 2018

(86) PCT No.: PCT/JP2018/022711
§ 371 (c)(1),
(2) Date: Dec. 10, 2019

(87) PCT Pub. No.: WO2019/021669
PCT Pub. Date: Jan. 31, 2019

(65) Prior Publication Data
US 2020/0145760 A1 May 7, 2020

(30) Foreign Application Priority Data
Jul. 27, 2017 (JP) ..... JP2017-145090

(51) Int. Cl.
*H04R 7/18* (2006.01)
*H04R 7/12* (2006.01)
*H04R 9/02* (2006.01)
*H04R 9/06* (2006.01)

(52) U.S. Cl.
CPC ..... *H04R 7/18* (2013.01); *H04R 7/12* (2013.01); *H04R 9/025* (2013.01); *H04R 9/06* (2013.01)

(58) Field of Classification Search
USPC ..... 381/300, 323, 396, 398, 335, 342
See application file for complete search history.

(56) References Cited

U.S. PATENT DOCUMENTS

2006/0110002 A1 5/2006 Pircaro et al.
2008/0212822 A1* 9/2008 Basnet ..... H04R 9/043 381/398
2011/0194724 A1 8/2011 Watanabe et al.
(Continued)

FOREIGN PATENT DOCUMENTS

CN 1794882 A 6/2006
CN 101946525 A 1/2011
(Continued)

OTHER PUBLICATIONS

International Search Report and Written Opinion of PCT Application No. PCT/JP2018/022711, dated Jul. 31, 2018, 09 pages of ISRWO.

*Primary Examiner* — Yosef K Laekemariam
(74) *Attorney, Agent, or Firm* — Chip Law Group

(57) ABSTRACT

An edge including an inner notch extending in a diaphragm-side region, and an outer notch extending in a frame-side region near the inner notch, in which the inner notch and the outer notch have a depression with a depth equal to or larger than a thickness, and an angle B formed by an extending direction of the outer notch with respect to a line radially extending from an edge center is larger than an angle A formed by an extending direction of the inner notch with respect to the line.

15 Claims, 11 Drawing Sheets

(56) References Cited

U.S. PATENT DOCUMENTS

| | | | | |
|---|---|---|---|---|
| 2015/0139477 | A1* | 5/2015 | Tripp | H04R 7/16<br>381/398 |
| 2016/0014522 | A1 | 1/2016 | Matsumura et al. | |
| 2016/0021463 | A1 | 1/2016 | Watanabe et al. | |
| 2017/0289698 | A1 | 10/2017 | Watanabe et al. | |

FOREIGN PATENT DOCUMENTS

| | | | |
|---|---|---|---|
| CN | 105050005 | A | 11/2015 |
| EP | 1659823 | A2 | 5/2006 |
| JP | 2004-048494 | A | 2/2004 |
| JP | 2006-148923 | A | 6/2006 |
| JP | 2007-281986 | A | 10/2007 |
| JP | 2016-171555 | A | 9/2016 |
| WO | 2009/107192 | A1 | 9/2009 |
| WO | 2015/076955 | A1 | 5/2015 |

* cited by examiner

EDGE OF DIAPHRAGM AND SPEAKER UNIT

CROSS REFERENCE TO RELATED APPLICATIONS

This application is a U.S. National Phase of International Patent Application No. PCT/JP2018/022711 filed on Jun. 14, 2018, which claims priority benefit of Japanese Patent Application No. JP 2017-145090 filed in the Japan Patent Office on Jul. 27, 2017. Each of the above-referenced applications is hereby incorporated herein by reference in its entirety.

TECHNICAL FIELD

The present technology relates to an edge of a diaphragm and a speaker unit that can improve sound quality.

BACKGROUND ART

As a speaker unit, a configuration in which a diaphragm is attached to a frame via an edge is known. A roll edge having a semicircular cross section, a roll edge having two semicircles, and the like are known. The edge has a damping effect on the diaphragm. Moreover, since the edge itself vibrates, the edge has a function as a part of the diaphragm. From these points, the influence of the edge on the sound quality of the speaker is not small.

For example, Patent Document 1 describes, to lower a reproduction limit of bass, integral formation of a plurality of groove-like ribs (grooves having a V-shaped cross-sectional shape) with an edge to easily deform an edge portion that elastically supports a diaphragm body to a frame and the like and decrease stiffness. Moreover, Patent Document 1 describes, to solve problems in the case of providing the ribs, provision of an adjustment member that partially improves bending strength of the edge on a part of a front surface or a back surface of the edge portion.

CITATION LIST

Patent Document

Patent Document 1: Japanese Patent Application Laid-Open No. 2004-048494

SUMMARY OF THE INVENTION

Problems to be Solved by the Invention

As a result of examining the displacement of the diaphragm and the deformation of the edge, asymmetry has been confirmed, in which a reaction force against movement of the edge is different between a case where the diaphragm is displaced forward and a case where the diaphragm is displaced backward. The reaction force is a force in a direction of preventing the movement of the edge. Such asymmetry cannot be corrected by the ribs as described in Patent Document 1. That is, Patent Document 1 describes that the ribs extend in a tangential direction of an inner peripheral edge of the edge (in other words, an outer peripheral edge of the diaphragm body) and are arranged at equal intervals in a peripheral direction. Then, while the ribs improve the bending strength in the direction in which the grooves extend (in other words, in the tangential direction of the outer peripheral edge of the diaphragm body), the ribs have a function to lower the bending strength by expansion and contraction of the groove width in a direction of crossing the grooves (in other words, a radial direction of the diaphragm body). As a result, the ribs enable the diaphragm to easily move, thereby reducing the stiffness.

If the stiffness is lowered too much, a reproduced sound is distorted in the diaphragm body and rolling or the like that causes noise due to mutual contact of vibration mechanisms is incurred, and the quality of the reproduced sound is reduced. The invention described in Patent Document 1 solves the problem. However, the ribs described in Patent Document 1 have a problem of not correcting the above-described asymmetry of change in the reaction force with respect to amplitude in a front-rear direction.

Therefore, an object of the present technology is to provide an edge of a diaphragm and a speaker unit by which asymmetry of change in a reaction force with respect to amplitude in a front-rear direction can be obtained.

Solutions to Problems

The present technology is an edge including:

an inner notch extending in a diaphragm-side region; and an outer notch extending in a frame-side region near the inner notch, in which the inner notch and the outer notch have a depression with a depth equal to or larger than a thickness, and an angle B formed by an edge center and an extending direction of the outer notch with respect to a line radially extending is larger than an angle A formed by an extending direction of the inner notch with respect to the line.

Furthermore, the present technology is a speaker unit having an edge supporting a diaphragm that is displaced by a drive signal, the edge including:

an inner notch extending in a diaphragm-side region and an outer notch extending in a frame-side region near the inner notch, in which the inner notch and the outer notch have a depression with a depth equal to or larger than a thickness, and an angle B formed by an extending direction of the outer notch with respect to a line radially extending from an edge center is larger than an angle A formed by an extending direction of the inner notch with respect to the line.

Effects of the Invention

According to at least one embodiment, the present technology can realize a speaker unit with low distortion and having better linearity of a relationship between the amplitude and the reaction force than that of an conventional edge. Furthermore, since an expansion and contraction operation becomes smooth, reduction of abnormal noise and rolling due to a hollow or the like, and reduction of influence of material hysteresis strain can be expected. Note that the effects described here are not necessarily limited, and any of effects described in the present technology may be exhibited.

MODE FOR CARRYING OUT THE INVENTION

Hereinafter, embodiments and the like of the present technology will be described with reference to the drawings. Note that the description will be given in the following order.

<1. Amplitude-Reaction Force Nonlinearity>
<2. First Embodiment>
<3. Second Embodiment>
<4. Third Embodiment>
<5. Fourth Embodiment>
<6. Modification>

Embodiments and the like described below are favorable specific examples of the present technology, and the contents of the present technology are not limited by these embodiments and the like.

Furthermore, in the following description, there are cases where only a part of a configuration is given a reference symbol or only a part of a configuration is simplified to prevent complication of illustration.

1. Amplitude-Reaction Force Asymmetry

Figure 1A:
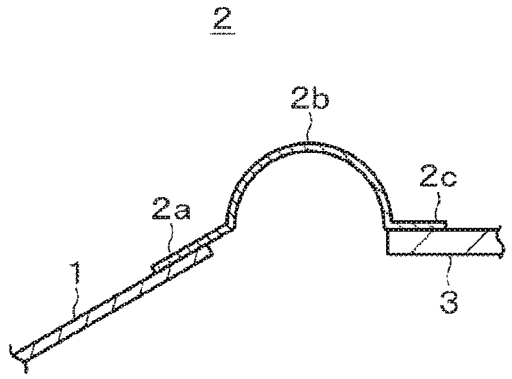
FIGS. 1A, 1B, and 1C are schematic diagrams for describing a conventional edge.

Prior to the description of the present technology, problems of a conventional edge will be described with reference to FIGS. 1A, 1B, and 1C. FIG. 1A illustrates a state in which no drive signal is input to a speaker unit, FIG. 1B illustrates a case in which a drive signal for displacing a diaphragm 1 downward (backward direction) is input to the speaker unit, and FIG. 1C illustrates a case in which a drive signal for displacing the diaphragm 1 upward (front direction) is input to the speaker unit.

Figure 1B:
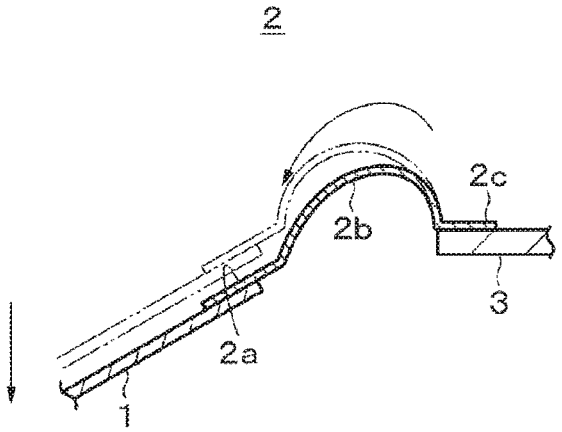
Figure 1C:
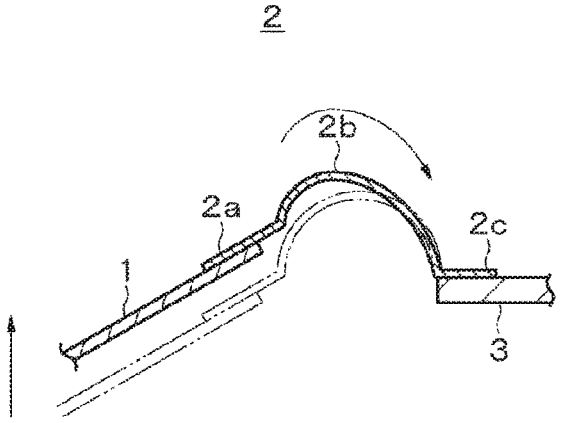

FIGS. 1A, 1B, and 1C illustrate a part of a configuration including the diaphragm 1 of the speaker unit. The diaphragm 1 has a cone shape, for example, and is formed using a material such as paper, polymer, or metal. A vicinity of an opening end of the diaphragm 1 is connected to an inner peripheral edge 2*a* of an edge 2. The edge 2 has a roll edge portion 2*b* integrated with the inner peripheral edge 2*a* and an outer peripheral edge 2*c* integrated with the roll edge portion 2*b*. The outer peripheral edge 2*c* is fixed to a frame 3. The edge 2 is formed using a material such as urethane foam or elastomer.

As illustrated in FIG. 1B, when the diaphragm 1 is displaced downward with respect to an original position illustrated by the two-dot chain lines, an outer side of the roll edge portion 2*b* falls to an inner side with a smaller diameter than the outer side, so the outer side contracts in a circumferential direction. In an extreme case, a dimple-like depression may occur in the roll edge portion 2*b*. Meanwhile, as illustrated in FIG. 1C, when the diaphragm 1 is displaced upward with respect to the original position indicated by the two-dot chain lines, the inner side of the roll edge portion 2*b* falls to the outer side with a larger diameter than the inner side, so the inner side extends in the circumferential direction. As described above, the conventional edge has asymmetry in a relationship between amplitude and reaction force due to its shape, and this asymmetry has caused distortion of a reproduced sound.

The distortion caused by the asymmetric relationship between the amplitude and the reaction force in the displacement direction of the diaphragm cannot be eliminated by a method of continuously cutting a notch into a roll edge portion from an outer side to an inner side, as described in Patent Document 1. According to the present technology, such distortion can be eliminated.

2. First Embodiment

"Configuration of Speaker Unit"

Figure 2:
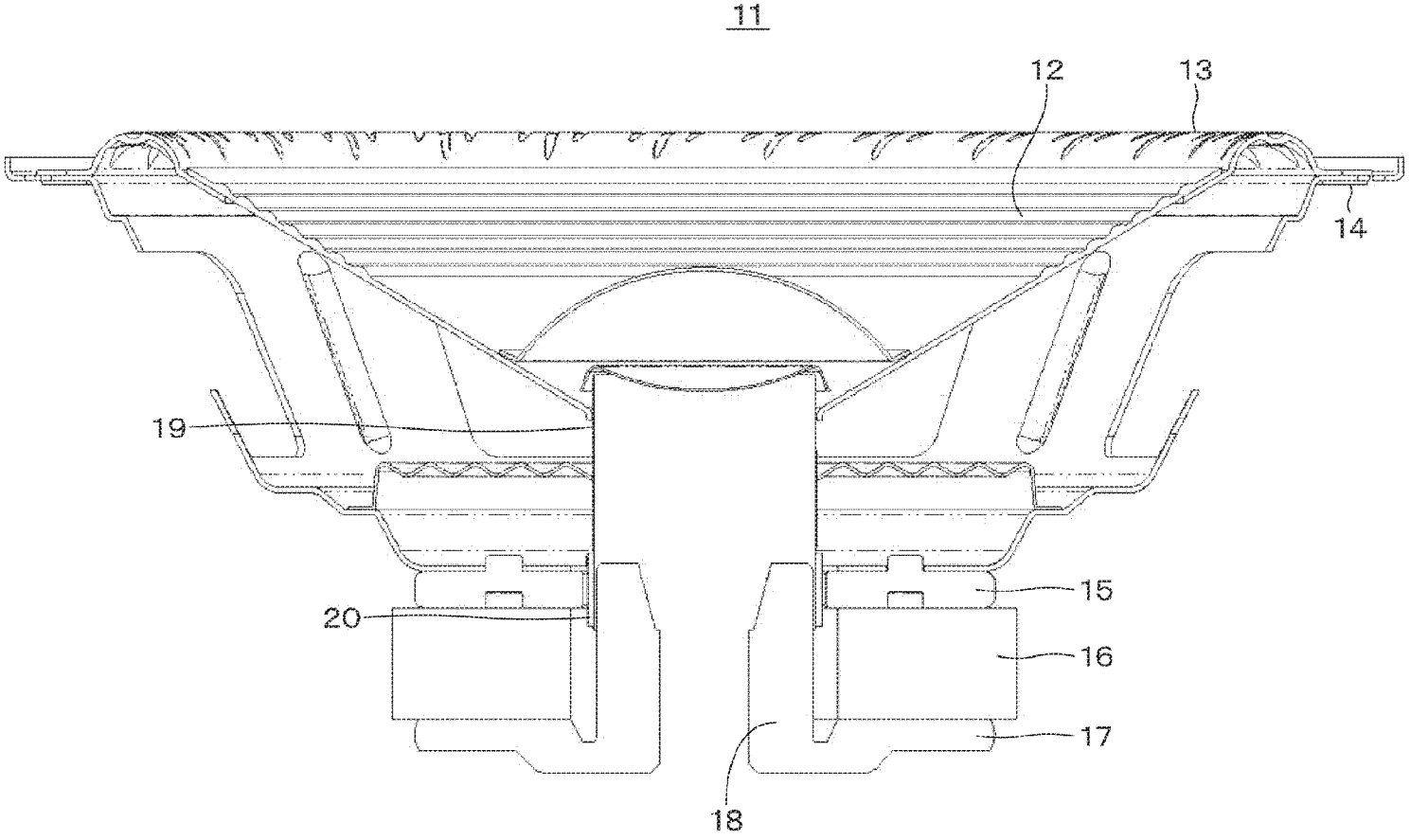
FIG. 2 is a cross-sectional view of a speaker unit according to a first embodiment of the present technology.
Figure 3:
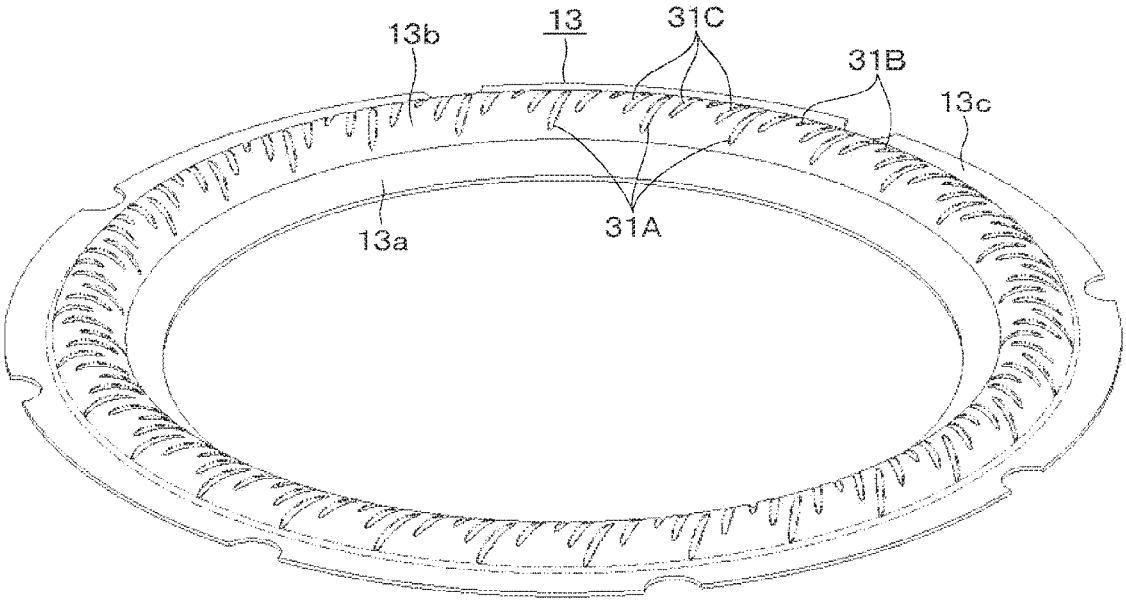
FIG. 3 is a perspective view of the edge according to the first embodiment.
Figure 4:
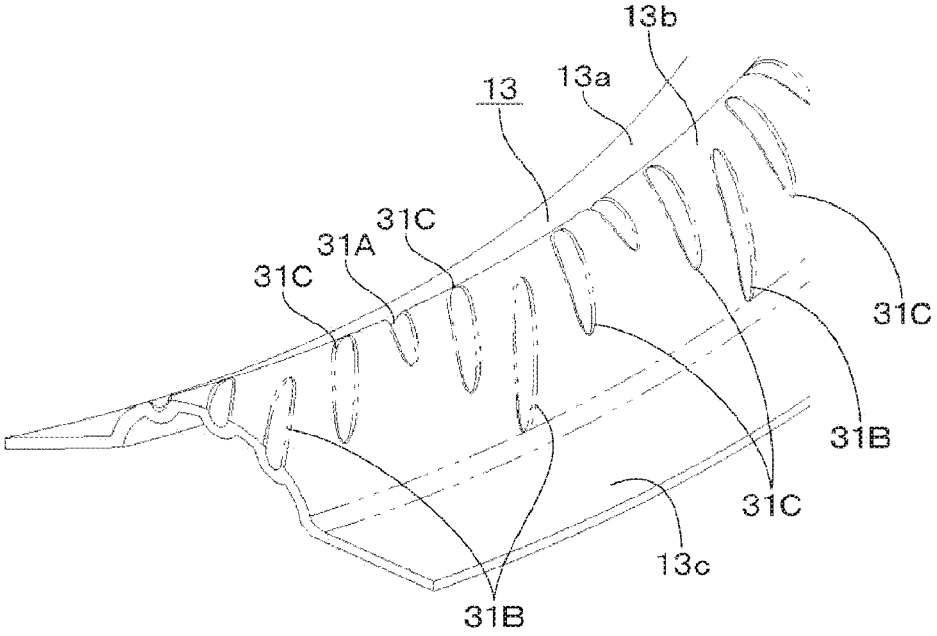
FIG. 4 is a partially enlarged perspective view of the edge according to the first embodiment.
Figure 5:
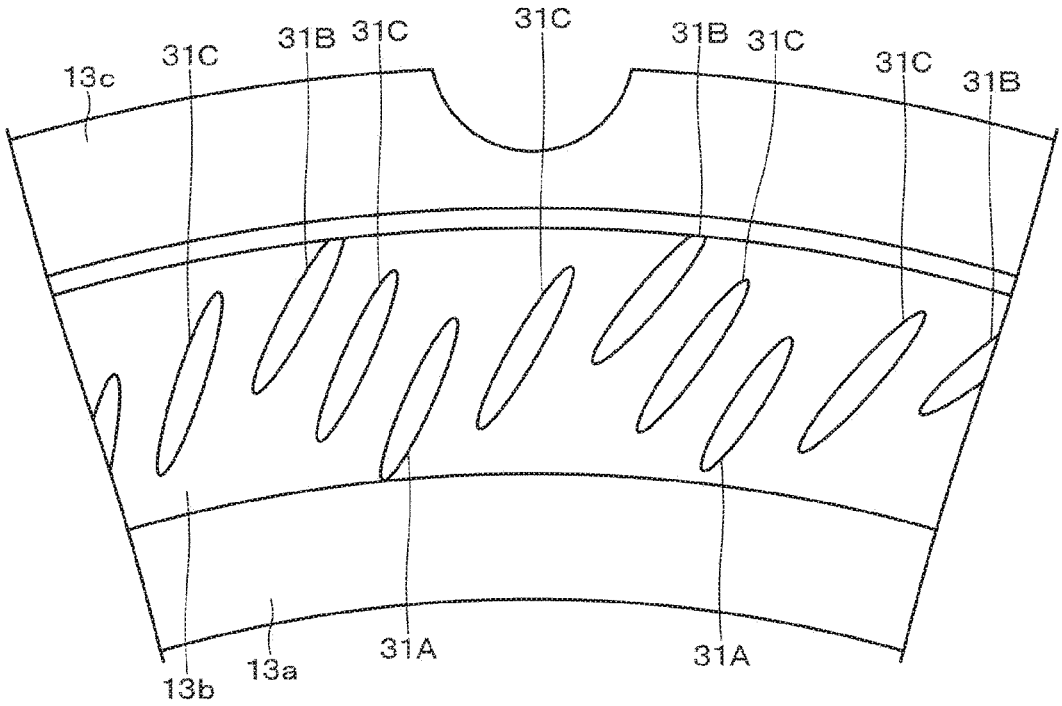
FIG. 5 is a partially enlarged view of the edge according to the first embodiment.

Hereinafter, a first embodiment of the present technology will be described in detail. FIG. 2 is a cross-sectional view of a speaker unit 11 according to the first embodiment of the present technology. A speaker unit 11 includes a cone-shaped diaphragm 12 in which reinforcing ribs are concentrically formed. An outer periphery of the diaphragm 12 is fixed to an inner peripheral edge of an edge 13, an outer edge portion of the edge 13 is fixed to a frame 14, and the diaphragm 12 is supported by the edge 13.

A plate 15 formed using a magnetic material is attached to the frame 14. The plate 15 is formed in a substantially annular shape. An annularly formed magnet 16 is attached to a rear surface of the plate 15. A yoke 17 is attached to a rear surface of the magnet 16.

The plate 15, the magnet 16, and the yoke 17 are coupled in a state where central axes are made coincident with one another. A coil bobbin 19 is supported on a center pole portion 18 of the yoke 17 in a front-rear direction, that is, in an axial direction of the center pole portion 18 in a displaceable (movable) manner. The coil bobbin 19 is formed in a cylindrical shape, and a front end of the coil bobbin 19 is fixed to the diaphragm 12. A voice coil 20 is wound around an outer peripheral surface of the coil bobbin 19. At least a part of the voice coil 20 is located in a magnetic gap. The voice coil 20 is located in the magnetic gap, so that the plate 15, the magnet 16, the yoke 17, and the voice coil 20 constitute a magnetic circuit. When a drive signal is supplied to the voice coil 20, the diaphragm 12 and the voice coil 20 are displaced.

When a drive voltage or a drive current is supplied to the voice coil 20 in the speaker unit 11 configured as described above, a thrust is generated in the magnetic circuit, and the coil bobbin 19 is displaced in the front-rear direction (axial direction) and the diaphragm 12 vibrates with the displacement of the coil bobbin 19. At this time, a sound is output in proportion to the voltage or current.

"Details of Edge"

The edge 13 will be described in more detail with reference to FIGS. 3, 4, 5, 6A, 6B, 6C, 6D, 6E, and 7. The edge 13 has a roll edge portion 13*b* integrated with an inner peripheral edge 13*a* and an outer peripheral edge 13*c* integrated with the roll edge portion 13*b*, and is formed into a circular shape. The inner peripheral edge 13*a* is connected to the outer periphery of the diaphragm 12, and the outer peripheral edge 13*c* is fixed to the frame 14. The roll edge portion 13*b* has a semicircular cross section. The edge 13 is formed using a material such as urethane foam or elastomer.

A plurality of notches 31 is provided at substantially uniform intervals in an entire circumference of the roll edge portion 13*b*. The notch 31 is a recess having a depth equal to or larger than a surface thickness, and an edge material of a portion where the notch 31 is formed is made equal to or thinner than the periphery in thickness, so that the notch 31 performs an opening and closing operation before the roll edge is significantly deformed into a hollow or the like by expansion and contraction in the circumferential direction, whereby the significant deformation can be prevented. Furthermore, the notch 31 is formed following a curvature of the roll edge portion 13*b*, and the roll shape of the roll edge portion 13*b* is prevented from being less easily deformed in a radial direction.

Figure 6A:
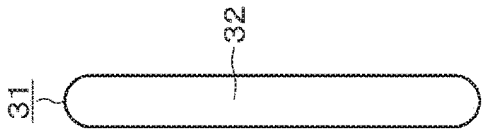
FIGS. 6A, 6B, 6C, 6D, and 6E are enlarged plan views and enlarged cross-sectional views for describing a notch.
Figure 6B:
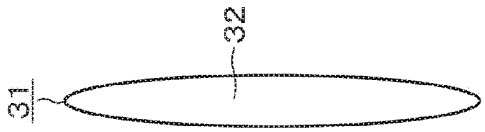

As illustrated in an enlarged manner in FIG. 6A, an example of the shape of the notch 31 projected on a plane has a stripe shape having an opening 32 with a substantially constant width, and an end portion of the shape is a curve, for example, a semicircle. As illustrated in an enlarged manner in FIG. 6B, the end portion of the notch 31 may be a tapered curve. For example, the notch 31 has a length of about 10 mm and an opening width of about 1 to 3 mm.

Figure 6C:
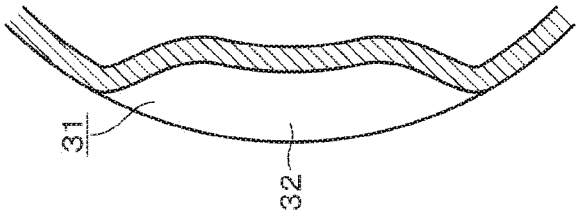
Figure 6D:
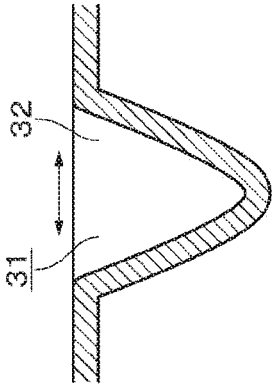
Figure 6E:
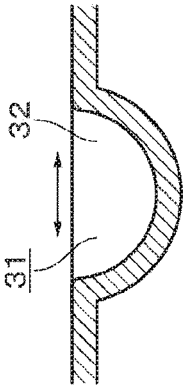

Moreover, FIG. 6C illustrates a cross section of the notch 31 in an extending direction, and FIGS. 6D and 6E illustrate cross sections of the notch 31 in a width direction. FIG. 6D illustrates an example in which the notch 31 has a substantially V-shaped cross section, and FIG. 6E illustrates an example in which the notch 31 has an arc-shaped cross section. Regardless of the shape, the opening is made to be easily opened and closed in the width direction (illustrated by the arrows).

The notches 31 include, as illustrated in FIGS. 4, 6A, 6B, 6C, 6D, and 6E, an inner notch 31A extending in a diaphragm-side region, that is, a region of the roll edge portion 13*b* near the inner peripheral edge 13*a*, an outer notch 31B extending in a frame-side region, that is, a region of the roll edge portion 13*b* near the outer peripheral edge 13*c*, near the inner notch 31A, and a center notch 31C extending in a region sandwiched by the inner notch 31A and the outer notch 31B. The inner notch 31A, the center notch 31C, and the outer notch 31B have shapes as described as the notch 31. However, the center notch 31C may be slightly longer in length or deeper in depth than the inner notch 31A and the outer notch 31B. Furthermore, the inner notch 31A extends to an outer side beyond a center position of the roll edge portion 13*b* in the width direction, and the outer notch 31B extends to an inner side beyond the center position in the width direction.

To prevent asymmetry of the relationship between the amplitude and the reaction force in a displacement direction of the diaphragm 12, the inner notch 31A and the outer notch 31B are formed. As described above, the outer side of the roll edge portion 13*b* contracts in the circumferential direction when the diaphragm 12 is displaced downward, whereas the inner side of the roll edge portion 13*b* extends in the circumferential direction when the diaphragm 12 is displaced upward. The inner notch 31A is formed to cope with the extension of the inner side, and the outer notch 31B is formed to cope with the contraction of the outer side.

Figure 7:
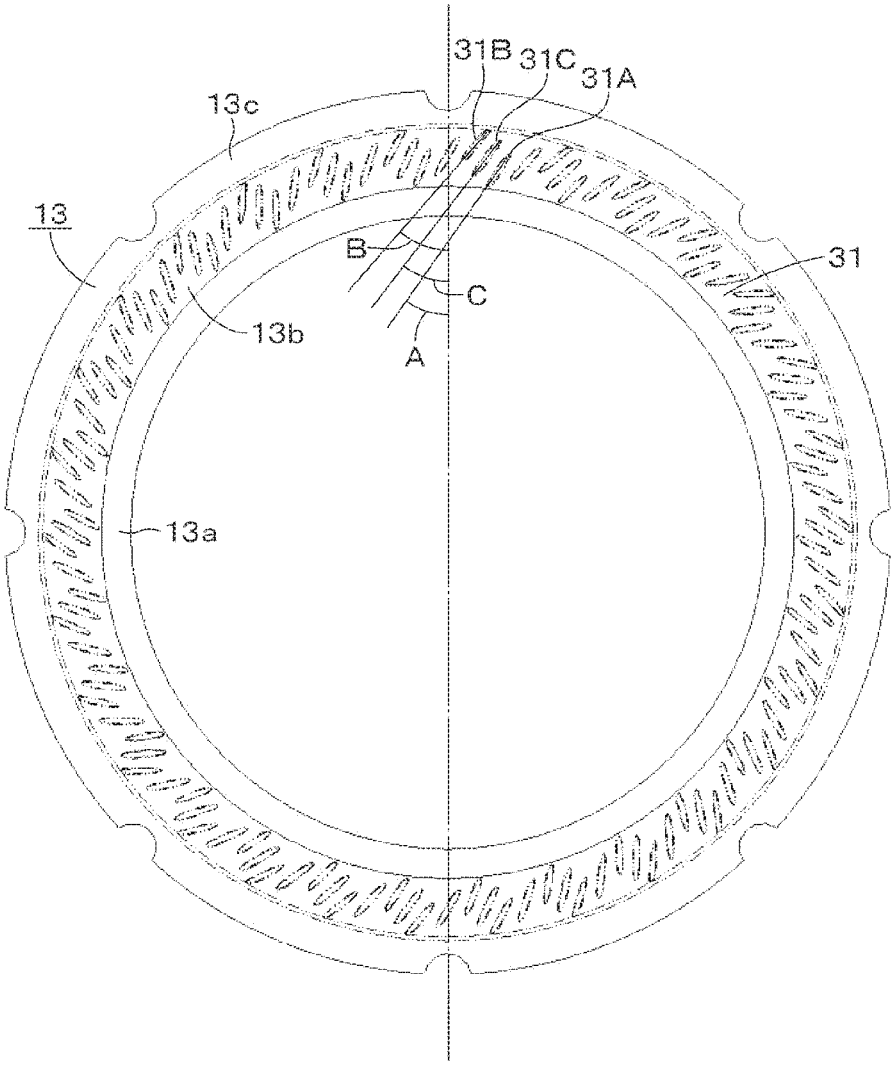
FIG. 7 is a plan view of the edge according to the first embodiment.

As illustrated in FIG. 7, an angle formed by a line radially extending from a center of the circular edge 13 (radial direction) and the inner notch 31A is denoted as A, an angle formed by the line and the outer notch 31B is denoted as B, and an angle made by the line and the center notch 31C is denoted as C, a relationship (A<C<B) is established. In the relationship of the angles, the angle B of the outer notch 31B having a large contracting operation in the circumferential direction is made larger with reference to the radial direction than the angle of the inner notch 31A having a large extending operation in the roll edge portion 13*a*. As described above, by providing the notches having different shapes in the inner side and the outer side, an optimal operation shape can be obtained with respect to expansion and contraction and the asymmetry of the reaction force with respect to the amplitude in the up-down direction can be improved. Actual angle values, notch depths, and the like can be obtained by simulation.

Moreover, the center notch 31C is formed in the roll edge portion 13*b* between the inner notch 31A and the outer notch 31B to avoid concentration of stress at the time of deformation. When the inner notch 31A, the outer notch 31B, and the center notch 31C are made into a group, the center notch 31C is interposed in a region between groups. That is, the number of the center notch 31C is doubled. Thus, stress concentration at the time of deformation can be avoided in the region between groups. Note that two or more center notches 31C interposed between the inner notch 31A and the outer notch 31B may be provided, and four, or four or more notches may be made into one group. In this case, the number of center notches 31C provided between groups is also two or more. Since a generated expansion and contraction margin is adjusted by providing more center notches 31C in this way, the stress concentration at the time of deformation can be avoided by making the inner and outer notches larger and deeper than the center notch.

"Improvement Effect"

Figure 8:
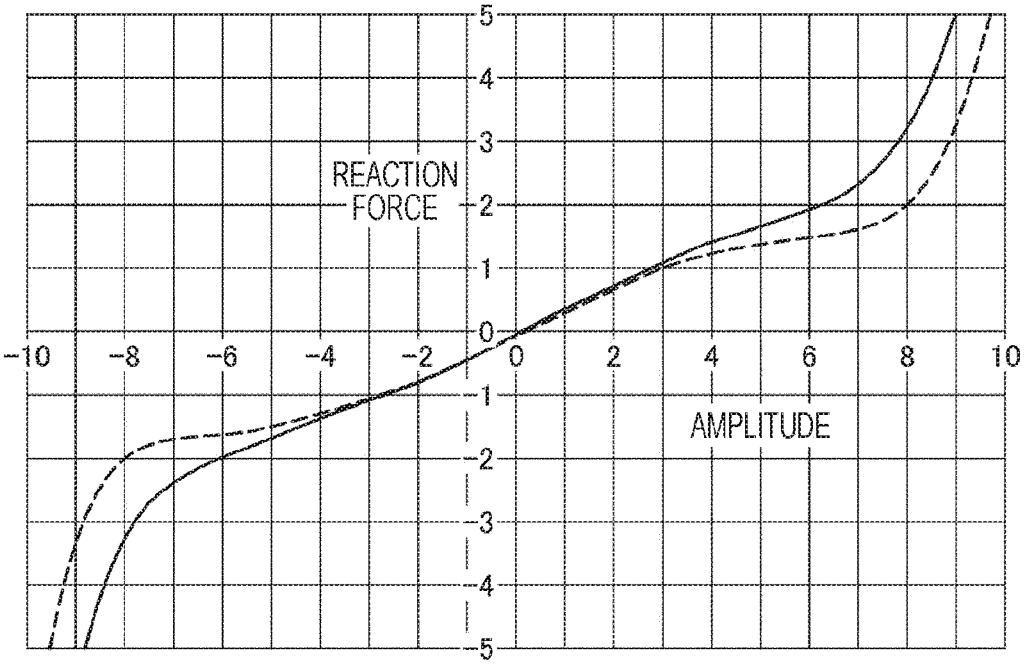
FIG. 8 is a graph illustrating characteristics of amplitude-reaction force.

FIG. 8 is a graph illustrating actual measurement results of the relationship between the amplitude and the reaction force of a diaphragm. The broken line in the graph in FIG. 8 illustrates the relationship between the amplitude and the reaction force regarding an edge without notches and the solid line in the graph illustrates the relationship between the amplitude and the reaction force of the first embodiment. As illustrated in the graph, the linearity of the relationship between the amplitude and the reaction force can be improved in the first embodiment, as compared with the conventional configuration. As a result, a speaker unit with less distortion can be configured.

3. Second Embodiment

Figure 9:
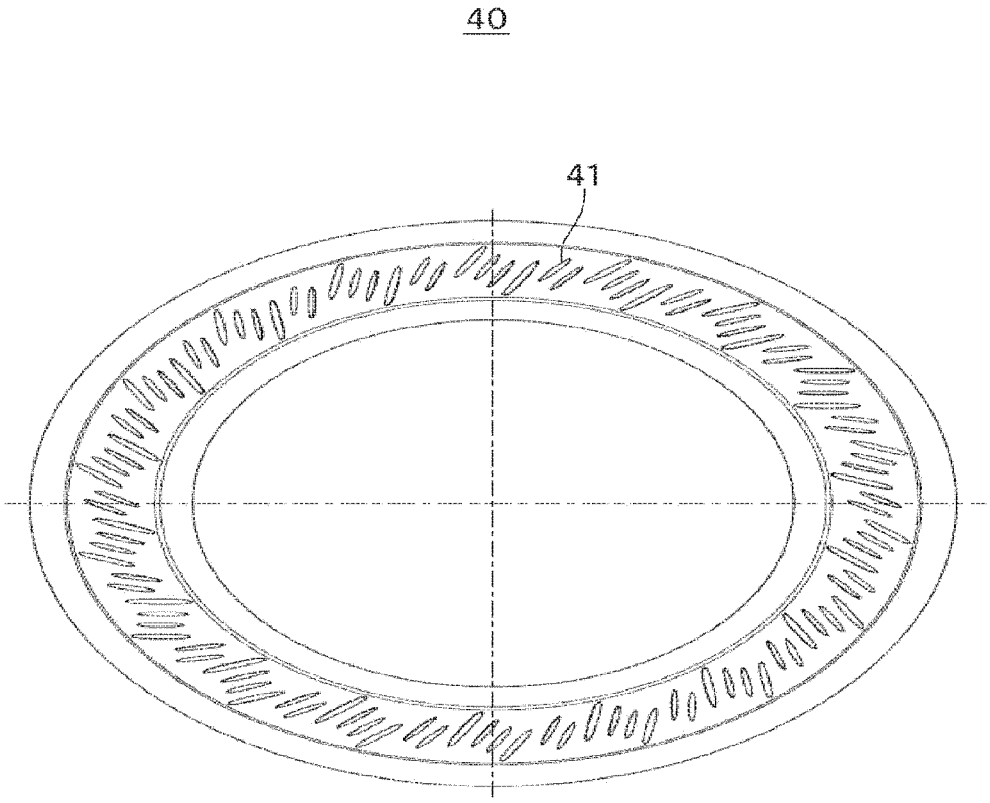
FIG. 9 is a plan view according to a second embodiment of the present technology.

In the above-described first embodiment, since the edge 13 has a circular shape, the roll edge portion 13*b* on the edge 13 has a uniform curvature, and the notches 31 are also formed with uniform density. There is an elliptical speaker unit. As illustrated in FIG. 9, in the case of an elliptical edge (roll edge) 40, the density at which notches 41 are provided is set according to the curvature. That is, the density of the notches 41 is higher in a region with a large curvature than a region with a small curvature. The second embodiment can improve the linearity of the relationship between the amplitude and the reaction force and can configure a speaker unit with less distortion, similarly to the above-described first embodiment.

4. Third Embodiment

Figure 10:
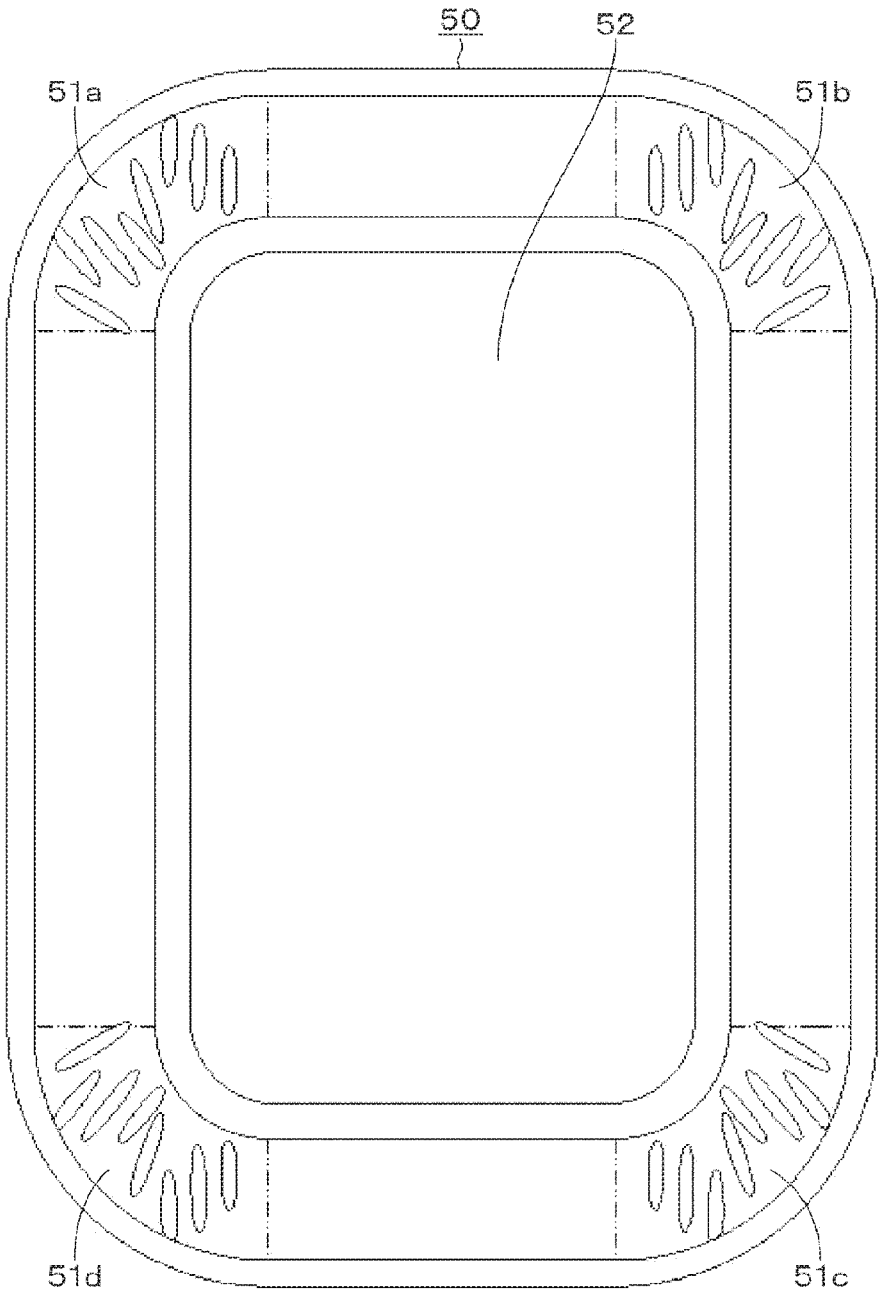
FIG. 10 is a plan view according to a third embodiment of the present technology.

The present technology can be applied not only to a cone-type diaphragm but also to a speaker unit having a planar diaphragm. FIG. 10 illustrates an example of an edge (roll edge) 50 that supports a rectangular planar diaphragm 52. Since four corners of the rectangular planar diaphragm 52 have a curvature, the edge 50 has notches 51*a*, 51*b*, 51*c*, and 51*d* only at the four corners. The third embodiment can improve the linearity of the relationship between the amplitude and the reaction force and can configure a speaker unit with less distortion, similarly to the above-described first embodiment.

5. Fourth Embodiment

Figure 11:
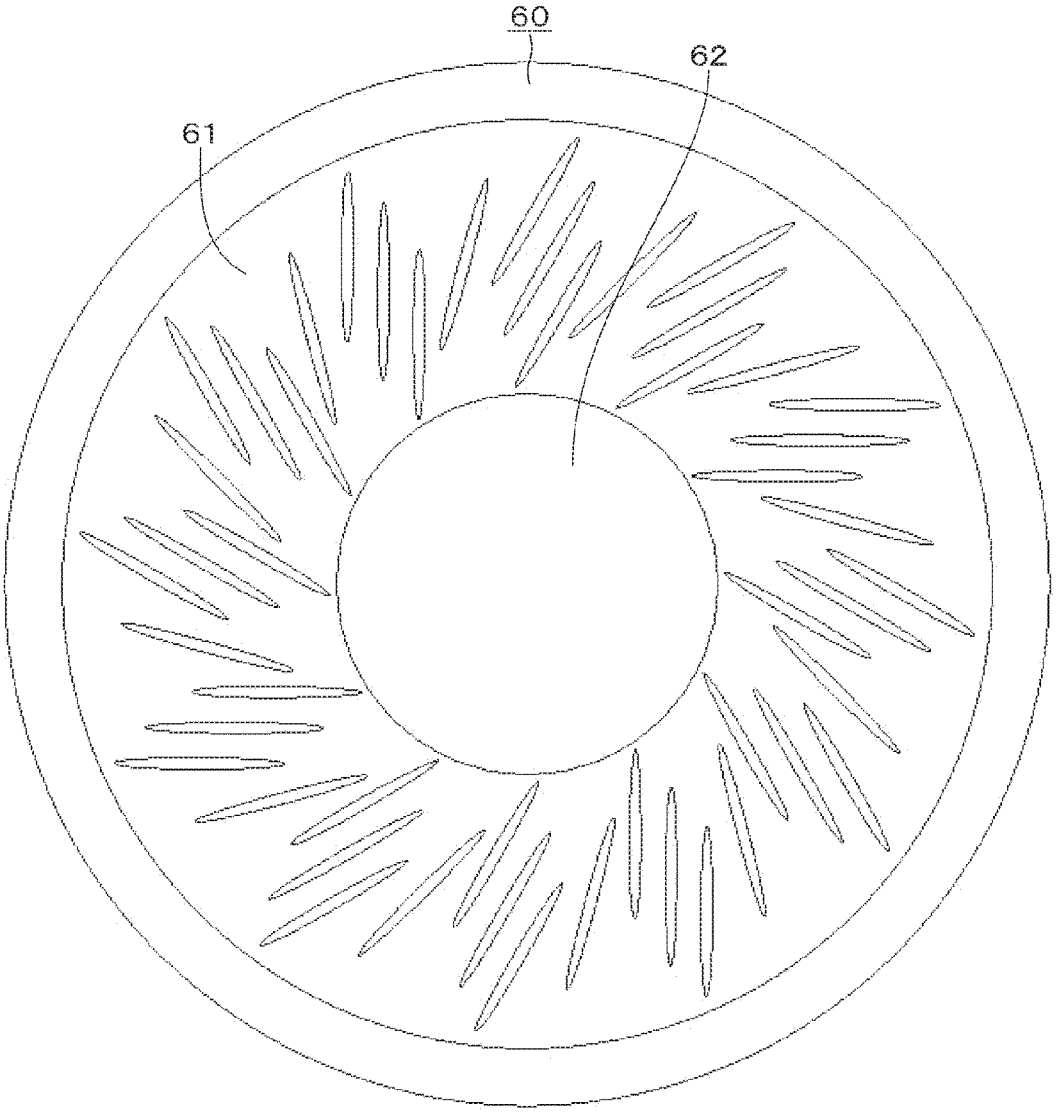
FIG. 11 is a plan view according to a fourth embodiment of the present technology.

The present technology can also be applied to an edge of a headphone unit. As illustrated in FIG. 11, an edge (roll edge) 60 supports a planar diaphragm 62 of the headphone unit. Since the edge 60 has a circular shape, notches 61 are formed with uniform density. The fourth embodiment can improve the linearity of the relationship between the amplitude and the reaction force and can configure a headphone unit with less distortion, similarly to the above-described first embodiment.

6. Modification

The embodiments of the present technology have been specifically described. However, the present technology is not limited to the above-described embodiments, and various modifications based on the technical idea of the present technology can be made. For example, the present technology can be applied to an edge in which two roll edge portions having a semicircular cross section are continuous, as the cross-sectional shape of the roll edge. In this case, a notch is provided for each roll edge portion. Moreover, the present technology can be applied to a passive radiator to obtain similar functions and effects.

The configurations, methods, steps, shapes, materials, numerical values, and the like given in the above-described embodiments are merely examples, and different configurations, methods, steps, shapes, materials, numerical values, and the like from the examples may be used as needed. The above-described embodiments and modifications can be combined as appropriate.

The present technology can also employ the following configurations.

(1)

An edge including:

an inner notch extending in a diaphragm-side region; and an outer notch extending in a frame-side region near the inner notch, in which the inner notch and the outer notch have a depression with a depth equal to or larger than a thickness, and an angle B formed by an extending direction of the outer notch with respect to a line radially extending from an edge center is larger than an angle A formed by an extending direction of the inner notch with respect to the line.

(2)

The edge according to (1), in which the inner notch and the outer notch have an elongated shape having an opening with a substantially constant width, and an end portion of the elongated shape is curved.

(3)

The edge according to (1) or (2), in which the inner notch extends to an outer side beyond a center position, and the outer notch extends to an inner side beyond a center position in a width direction.

(4)

The edge according to any one of (1) to (3), in which the inner notch and the outer notch are provided in a region having a curved contour.

(5)

The edge according to (1), further including:

a center notch located between the inner notch and the outer notch, in which the center notch has a depression with a depth equal or larger than a thickness, and an angle C formed by an extending direction of the center notch with respect to a line radially extending from an edge center is set to a relationship of (A<C<B).

(6)

The edge according to (5), in which two or more center notches are provided between the inner notch and the outer notch.

(7)

The edge according to claim (5) or (6), in which the inner notch, the outer notch, and the center notch have an elongated shape having an opening with a substantially constant width, and an end portion of the elongated shape is curved.

(8)

The edge according to any one of (5) to (7), in which the inner notch, the outer notch, and the center notch are provided in a region having a curved contour.

(9)

The edge according to any one of (5) to (8), in which a plurality of groups of the inner notch, the outer notch, and the center notch is provided, and a center notch is interposed between the groups.

(10)

A speaker unit having an edge supporting a diaphragm that is displaced by a drive signal, the edge including:

an inner notch extending in a diaphragm-side region and an outer notch extending in a frame-side region near the inner notch, in which the inner notch and the outer notch have a depression with a depth equal to or larger than a thickness, and an angle B formed by an extending direction of the outer notch with respect to a line radially extending from an edge center is larger than an angle A formed by an extending direction of the inner notch with respect to the line.

REFERENCE SIGNS LIST

11 Speaker unit
12 Diaphragm
13 Edge
13*a* Inner peripheral edge
13*b* Roll edge portion
13*c* Outer peripheral edge
31 Notch
31A Inner notch
31B Outer notch
31C Center notch

The invention claimed is:

1. An edge, comprising:

a roll edge portion that includes a diaphragm-side region and a frame-side region;

an inner notch that extends in the diaphragm-side region to an outer side beyond a center position of the roll edge portion in a width direction of the roll edge portion; and an outer notch that extends in the frame-side region to an inner side beyond the center position of the roll edge portion in the width direction, wherein the inner notch and the outer notch have a first depression with a first depth one of equal to or larger than a specific thickness, an angle B is between an extending direction of the outer notch and a line that radially extends from a center of the edge, an angle A is between an extending direction of the inner notch and the line, and the angle B is larger than the angle A.

2. The edge according to claim 1, wherein the inner notch and the outer notch have an elongated shape that includes:

an opening with a substantially constant width; and an end portion that has a curved shape.

3. The edge according to claim 1, wherein the roll edge portion has a curved contour.

4. The edge according to claim 1, further comprising a first center notch between the inner notch and the outer notch, wherein the first center notch has a second depression with a second depth one of equal to or larger than the specific thickness, and an angle C between an extending direction of the first center notch and the line is greater than the angle A and smaller than the angle B.

5. The edge according to claim 4, further comprising at least two center notches between the inner notch and the outer notch, wherein the at least two center notches include the first center notch.

6. The edge according to claim 4, wherein the inner notch, the outer notch, and the first center notch have an elongated shape that includes:

an opening with a substantially constant width; and an end portion that has a curved shape.

7. The edge according to claim 4, wherein the roll edge portion that includes the inner notch, the outer notch, and the first center notch has a curved contour.

8. The edge according to claim 4, further comprising:

a plurality of groups, wherein each group of the plurality of groups includes the inner notch, the outer notch, and the first center notch; and a second center notch between the plurality of groups.

9. A speaker unit, comprising:

an edge; and a diaphragm configured to move based on a drive signal, wherein the edge supports the diaphragm, and the edge includes:

a roll edge portion that includes a diaphragm-side region and a frame-side region;

an inner notch that extends in the diaphragm-side region to an outer side beyond a center position of the roll edge portion in a width direction of the roll edge portion; and an outer notch that extends in the frame-side region to an inner side beyond the center position of the roll edge portion in the width direction, wherein the inner notch and the outer notch have a depression with a depth one of equal to or larger than a specific thickness, and an angle B is between an extending direction of the outer notch and a line that radially extends from a center of the edge;

an angle A is between an extending direction of the inner notch and the line, and the angle B is larger than the angle A.

10. An edge, comprising:

a roll edge portion that includes a diaphragm-side region and a frame-side region;

an inner notch that extends in the diaphragm-side region; and an outer notch that extends in the frame-side region, wherein the inner notch and the outer notch have:

an elongated shape that includes:

an opening with a substantially constant width; and an end portion that has a curved shape, and a depression with a depth one of equal to or larger than a specific thickness, an angle B is between an extending direction of the outer notch and a line that radially extends from a center of the edge, an angle A is between an extending direction of the inner notch and the line, and the angle B is larger than the angle A.

11. An edge, comprising:

a roll edge portion that includes a diaphragm-side region and a frame-side region;

an inner notch that extends in the diaphragm-side region;

an outer notch that extends in the frame-side region; and a first center notch between the inner notch and the outer notch, wherein the inner notch and the outer notch have a first depression with a first depth one of equal to or larger than a specific thickness, the first center notch has a second depression with a second depth one of equal to or larger than the specific thickness, an angle B is between an extending direction of the outer notch and a line that radially extends from a center of the edge, an angle A is between an extending direction of the inner notch and the line, the angle B is larger than the angle A, and an angle C between an extending direction of the first center notch and the line is greater than the angle A and smaller than the angle B.

12. The edge according to claim 11, further comprising at least two center notches between the inner notch and the outer notch, wherein the at least two center notches include the first center notch.

13. The edge according to claim 11, wherein the inner notch, the outer notch, and the first center notch have an elongated shape that includes:

an opening with a substantially constant width; and an end portion that has a curved shape.

14. The edge according to claim 11, wherein the roll edge portion that includes the inner notch, the outer notch, and the first center notch has a curved contour.

15. The edge according to claim 11, further comprising:

a plurality of groups, wherein each group of the plurality of groups includes the inner notch, the outer notch, and the first center notch; and a second center notch between the plurality of groups.

* * * * *